US005165127A

United States Patent [19]

Nicholson

[11] Patent Number: 5,165,127

[45] Date of Patent: Nov. 24, 1992

[54] HEATING AND COOLING BLANKET APPARATUS

[76] Inventor: Barry Nicholson, 4475 W. 16th Pl., Yuma, Ariz. 85364

[21] Appl. No.: 824,606

[22] Filed: Jan. 23, 1992

[51] Int. Cl.[5] ..... A47C 21/04

[52] U.S. Cl. ..... 5/421; 5/485; 5/502; 62/261; 165/46

[58] Field of Search ..... 5/284, 421, 485, 502; 62/261; 219/217; 128/376, 400; 165/46

[56] References Cited

U.S. PATENT DOCUMENTS

| | | | |
|---|---|---|---|
| 1,817,277 | 8/1931 | Uhlig | 5/421 X |
| 2,504,308 | 4/1950 | Donkle, Jr. | 5/485 |
| 2,753,435 | 7/1956 | Jepson | 165/46 X |
| 2,866,072 | 12/1958 | Smith | 165/46 X |
| 3,894,213 | 7/1975 | Agarwala | 165/46 X |
| 4,884,304 | 12/1989 | Elkins | 5/421 X |

*Primary Examiner*—Michael F. Trettel
*Attorney, Agent, or Firm*—Leon Gilden

[57] ABSTRACT

A blanket includes a cavity therewithin defined between spaced layers of the blanket directing a fluid conduit therethrough. The fluid conduit is in cooperative and fluid communication with a control housing to include cooling and heating structure in association with a pump to direct cooled or heating fluid through the conduit within the blanket cavity. A modification of the invention includes a secondary reservoir to include fluid at ambient air temperature to stabilize a blanket temperature as an alternative to creating a temperature gradient relative to the ambient temperature environment of the blanket.

4 Claims, 6 Drawing Sheets

HEATING AND COOLING BLANKET APPARATUS

BACKGROUND OF THE INVENTION

1. Field of the Invention

The field of invention relates to blanket apparatus, and more particularly pertains to a new and improved heating and cooling blanket apparatus wherein the same is arranged to effect the selective heating and cooling of the blanket for comfort and convenience of users thereof.

2. Description of the Prior Art

Blanket structure of various types have been utilized in the prior art to effect comfort of individuals and a prior art structure as set forth in the U.S. Pat. No. 4,132,262 to Wibell sets forth a heating and cooling blanket structure to effect regulation of various zones in a blanket utilizing a fluid medium.

U.S. Pat. No. 4,777,802 to Feher stes forth a blanket structure providing heating and cool air thereto.

U.S. Pat. No. 4,906,168 Thompson sets forth a pump structure utilizing elastomeric tubing within a framework to effect a pumping action through the tubing.

U.S. Pat. No. 4,094,357 to Scroi sets forth at heat transfer blanket.

U.S. Pat. No. 4,859,250 to Buist sets forth a thermoelectric pillow and blanket structure utilizing various heating strips within coal strip portions.

As such, it may be appreciated there continues to be a need for a new and improved heating and cooling blanket apparatus as set forth by the instant invention which addresses both the problems of ease of use as well as effectiveness in construction utilizing a fluid conduit directing medium throughout the blanket structure for selective heating and cooling of the blanket in use and in this respect, the present invention substantially fulfills this need.

SUMMARY OF THE INVENTION

In view of the foregoing disadvantages inherent in the known types of heating and cooling blanket apparatus now present in the prior art, the present invention provides a heating and cooling blanket apparatus wherein the same utilizes a fluid conduit to direct a medium arranged for directing a heating or cold fluid therethrough. As such, the general purpose of the present invention, which will be described subsequently in greater detail, is to provide a new and improved heating and cooling blanket apparatus which has all the advantages of the prior art heating and cooling blanket apparatus and none of the disadvantages.

To attain this, the present invention provides a blanket including a cavity therewithin defined between spaced layers of the blanket directing a fluid conduit therethrough. The flui conduit is in cooperative and fluid communication with a control housing to include cooling and heating structure in association with a pump to direct cooled or heating fluid through the conduit within the blanket cavity. A modification of the invention includes a secondary reservoir to include fluid at ambient air temperature to stabilize a blanket temperature as an alternative to creating a temperature gradient relative to the ambient temperature environment of the blanket.

My invention resides not in any one of these features per se, but rather in the particular combination of all of them herein disclosed amd claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved heating and cooling blanket apparatus which has all the advantages of the prior art heating and cooling blanket and none of the disadvantages.

It is another object of the present invention to provide a new and improved heating and cooling blanket apparatus which may be easily and efficiently manufactured and marketed.

It is a further object of the present invention to provide a new and improved heating and cooling blanket apparatus which is of a durable and reliable construction.

An even further object of the present invention is to provide a new and improved heating and cooling blanket apparatus which is susceptible of a low cost of manufacture with regard to both materials and labor, and which accordingly is then susceptible of low prices of sale to the consuming public, thereby making such heating and cooling blanket apparatus economically available to the buying public.

Still yet another object of the present invention is to provide a new and improved heating and cooling blanket apparatus which provides in the apparatusses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, references should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
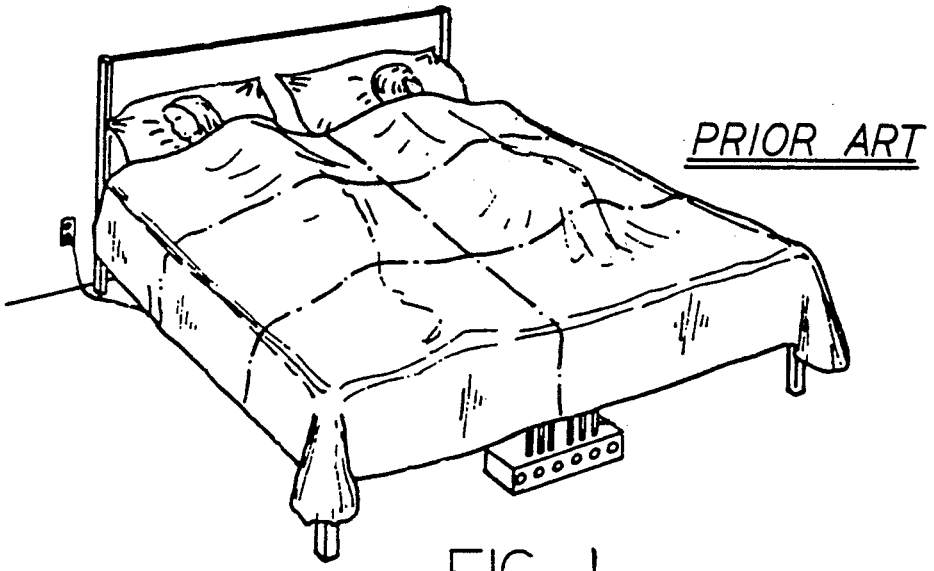
FIG. 1 is an isometric illustration of a prior art heating and cooling blanket structure, as set forth in the U.S. Pat. No. 4,132,262.

With reference now to the drawings, and in particular to FIGS. 1 to 12 thereof, a new and improved heating and cooling blanket apparatus embodying the principles and concepts of the present invention and generally designated by the reference numeral 10 will be described.

Figure 2:
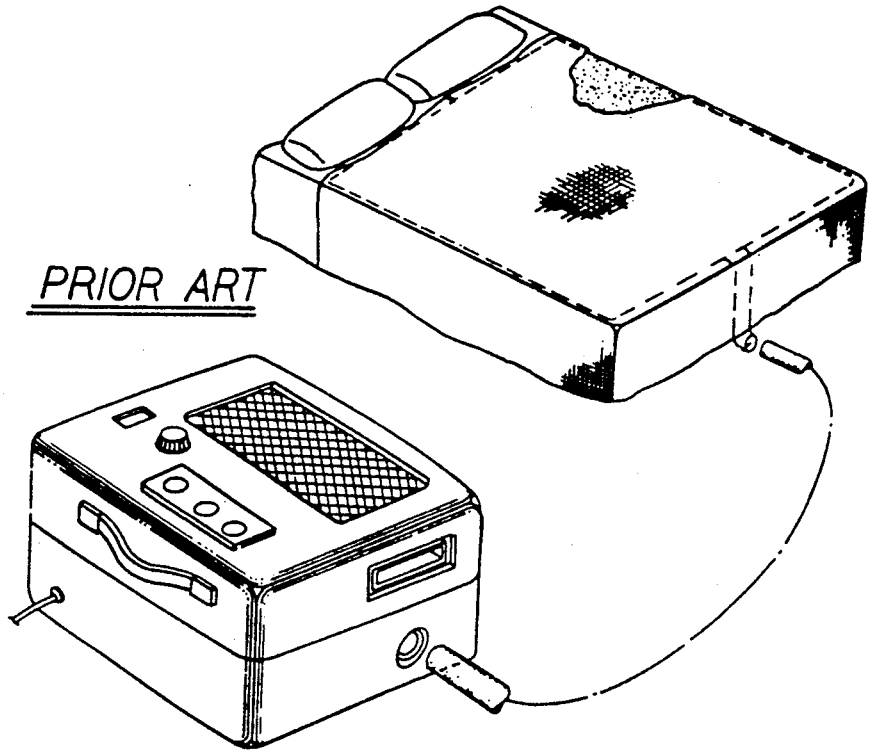
FIG. 2 is a prior art isometric illustration of a blanket structure to direct heated or cooled air therethrough, in a manner as set forth in U.S. Pat. No. 4,777,802.

The FIGS 1 and 2 set forth examples of heating and cooling blanket structure utilizing a fluid and air directing medium throughout the blanket structure as set forth in the U.S. Pat. No. 4,132,262 and 4,777,802 respectively.

Figure 3:
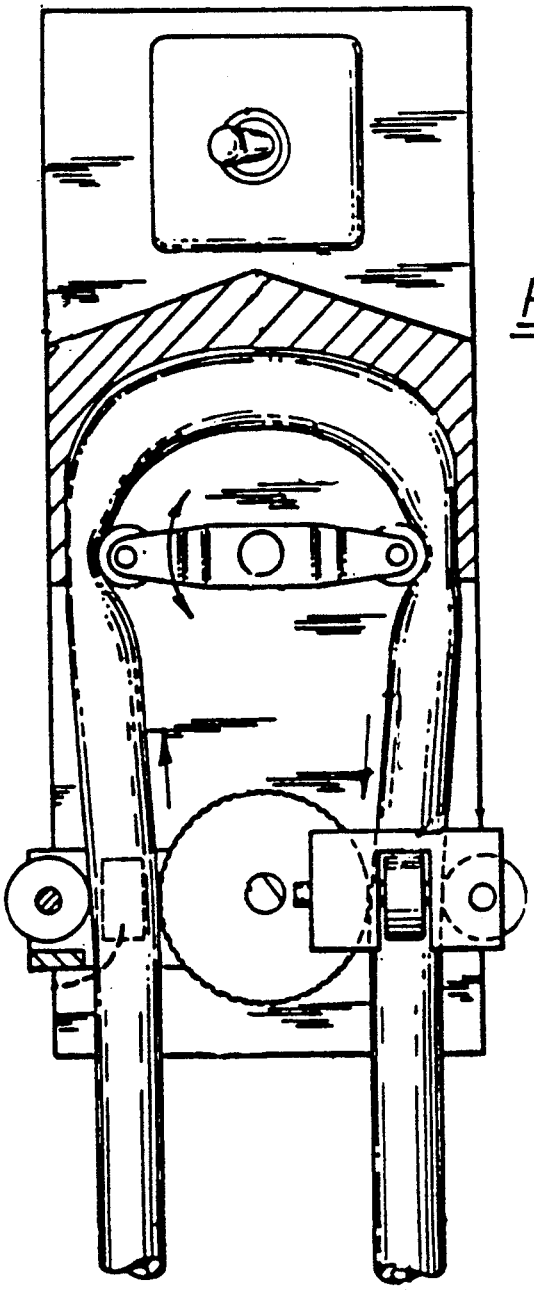
PRIOR ART FIG 3
FIG. 3 is an orthographic cross-sectional view of a pump structure, as set forth in U.S. Pat. No. 4,906,168.
Figure 4:
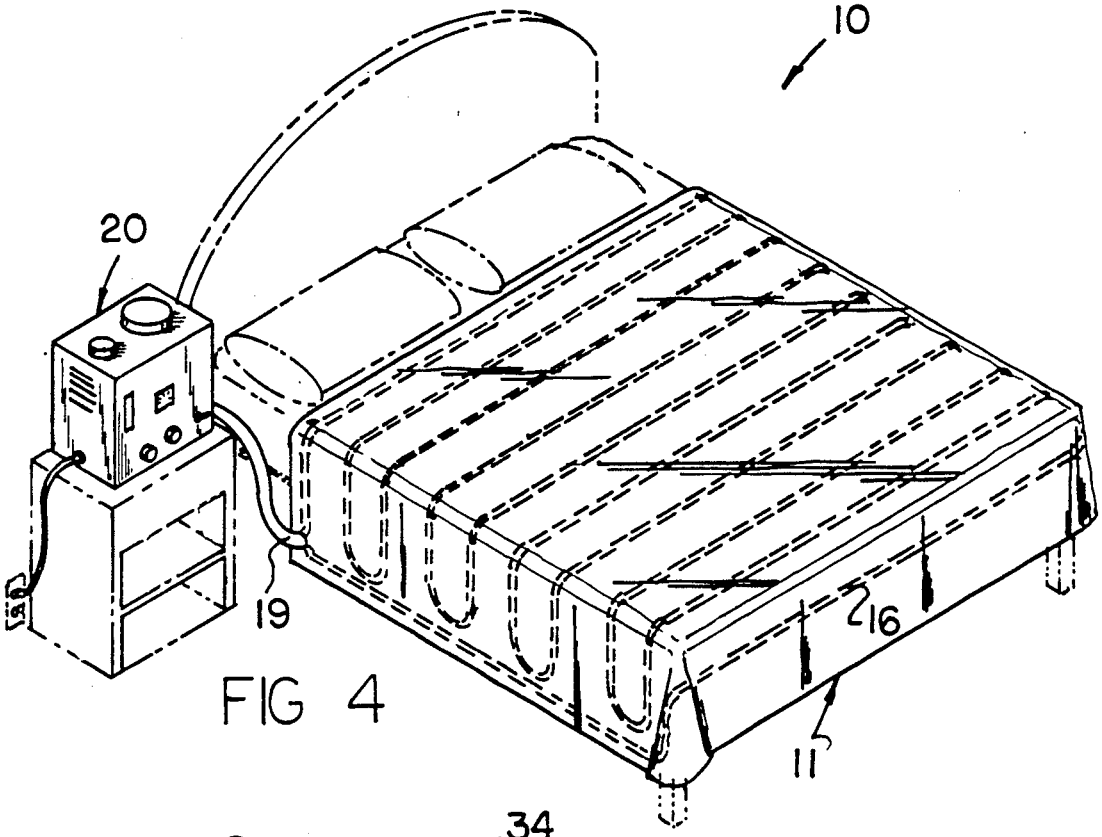
FIG. 4 is an isometric illustration of the instant invention.
Figure 5:
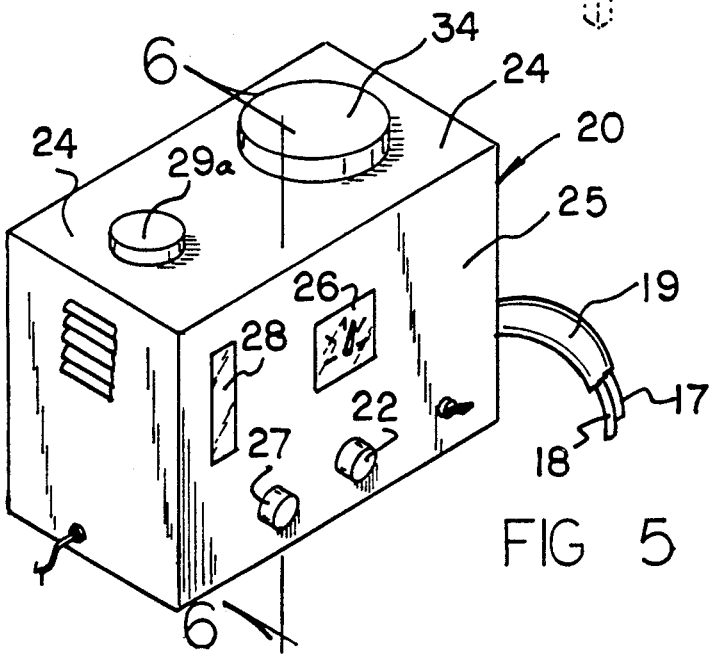
FIG. 5 is an isometric illustration of the control housing of the instant invention.
Figure 6:
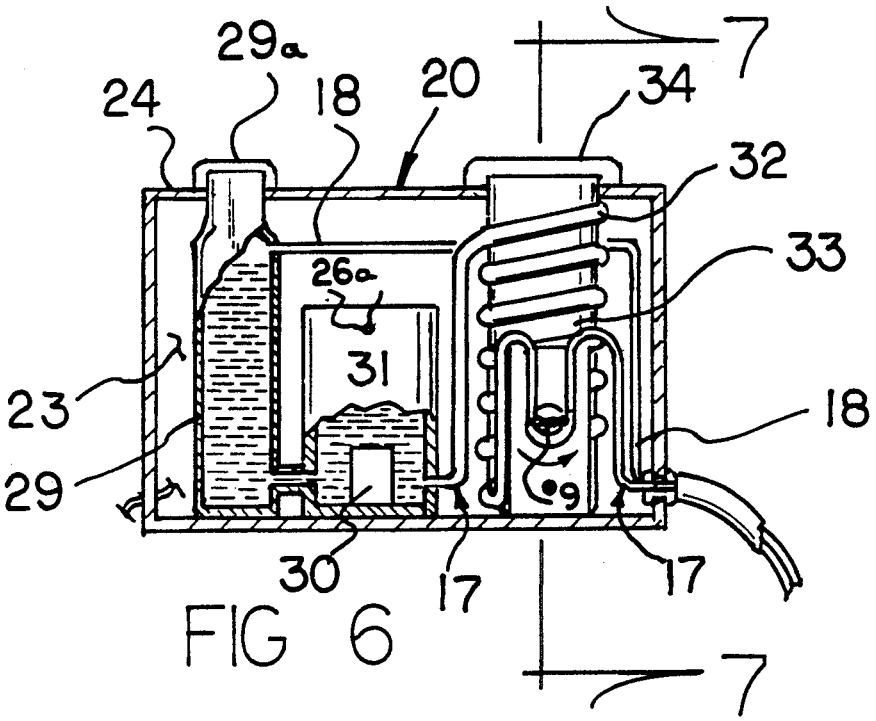
FIG. 6 is an orthographic view, taken along the lines 6—6 of FIG. 5 in the direction indicated by the arrows.

FIG. 3 sets forth the use of a pump structure to direct fluid utilizing a rotary pump arm 9 to effect pumping through the associated conduit structure, in a manner as set forth in U.S. Pat. No. 4,906,168 incorporated herein by reference.

Figure 7:
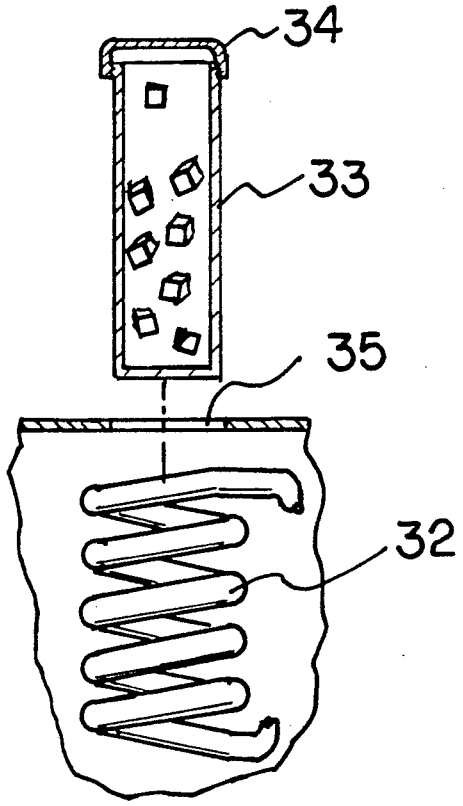
FIG. 7 is an orthographic view, taken along the lines 7—7 of FIG. 6 in the direction indicated by the arrows.
Figure 8:
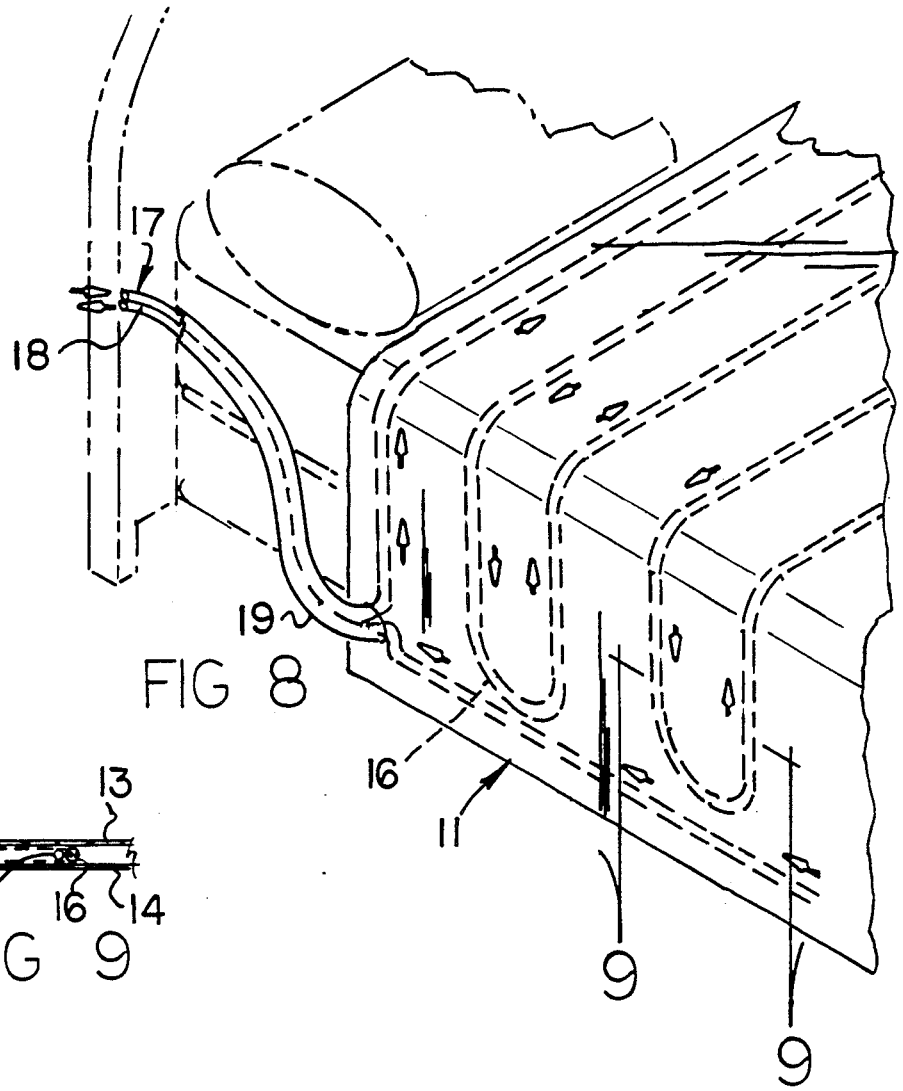
FIG. 8 is an enlarged isometric illustration of the conduit structure utilized by the invention.
Figure 9:
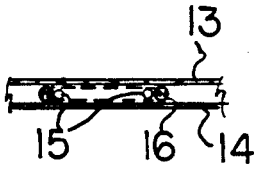
FIG. 9 is an orthographic view, taken along the lines 9—9 of FIG. 8 in the direction indicated by the arrows.
Figure 10:
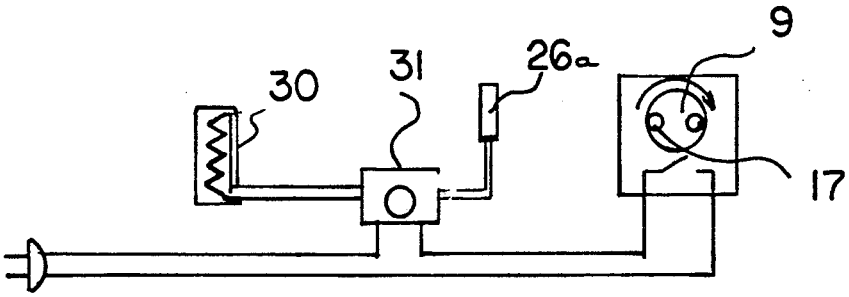
FIG. 10 is a schematic illustration of the heating structure utilized by the invention.
Figure 12:
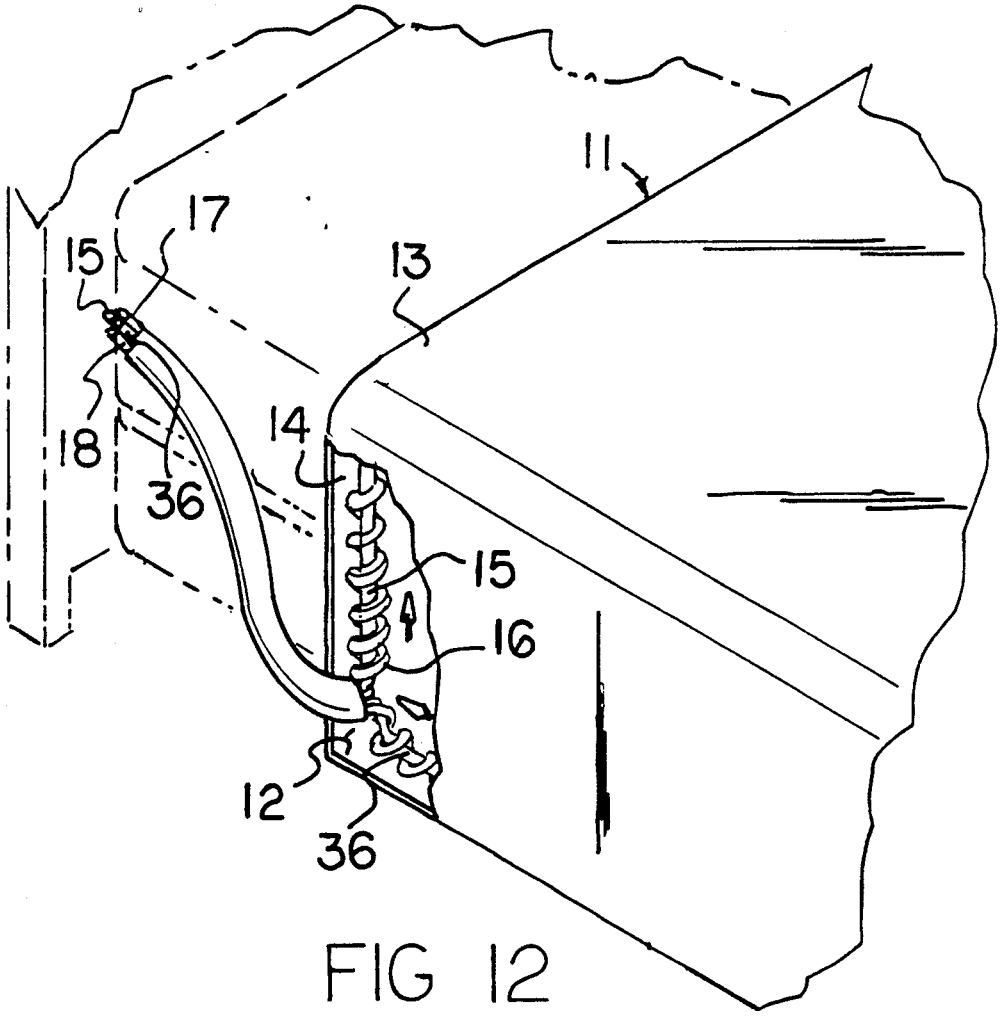
FIG. 12 is an isometric illustration of the additional fluid transfer conduits directed into the blanket structure of the invention.

More specifically, the heating and cooling blanket apparatus 10 of the instant invention essentially comprises a flexible blanket member 11, such as illustrated in FIG. 12, to include a respective first and second layer 13 and 14 that are coextensive relative to one another defining a blanket cavity 12 therebetween. A tubular guide mandrel 15, such as illustrated in FIG. 12, is provided and is directed coextensively within the cavity 12, with a helical fluid-flow conduit 16 directed thereabout to effect proper orientation of the conduit 16. The conduit 16 includes an input conduit 17 and a return conduit 18 to effect return of fluid from the input conduit 17. A covering sheath 19 is directed between the blanket member 11 and a control housing 20. The control housing 20 includes a pump member, such as illustrated in FIG. 7, utilizing a rotary pump arm 9 of a type and construction as set forth in the U.S. Pat. No. 4,906,168 as reference to above. The control housing 20 includes a control housing top wall 24 and a control housing front wall 25, with a housing cavity 23 contained within the control housing containing the pump member as well as the various components. Pump speed control 22 mounted to the front wall 25 effects selective rotation of the rotary pump arm 9. A thermostat 26 is provided in cooperation with a temperature sensor **26*a* and a thermostatic control 27 to effect selective heating within the fluid heating container 31, with a heating member 30 positioned within the heating member to effect heating of the fluid therewithin that is directed from the fluid reservoir 29 in adjacency relative to the fluid heating container 31 within the housing cavity 23. The further reservoir 29 includes a fluid reservoir lid 29*a* to permit selective replenishment of and refilling of fluid within the fluid reservoir 29, as well as permitting the servicing thereof, such as the injection of various bactericides and the like within the fluid within the reservoir 29. The fluid reservoir 29, as well as the fluid heating container 31 positioned in adjacency thereto, are fixedly mounted within te housing cavity 23. The input conduit 17 is directed from the reservoir 29 to the heating container 31 and about the input container 17 configured as a helical cooling coil 32 about an associated cooling container 33 that is slidably and coaxilly mounted within the cooling coil container 32 through an associated top wall opening 35. In this manner, the container 33 may be removed for the ease of positioning of a cooling medium such as "dry ice" and the like therewithin through the container lid 34**.

Figure 11:
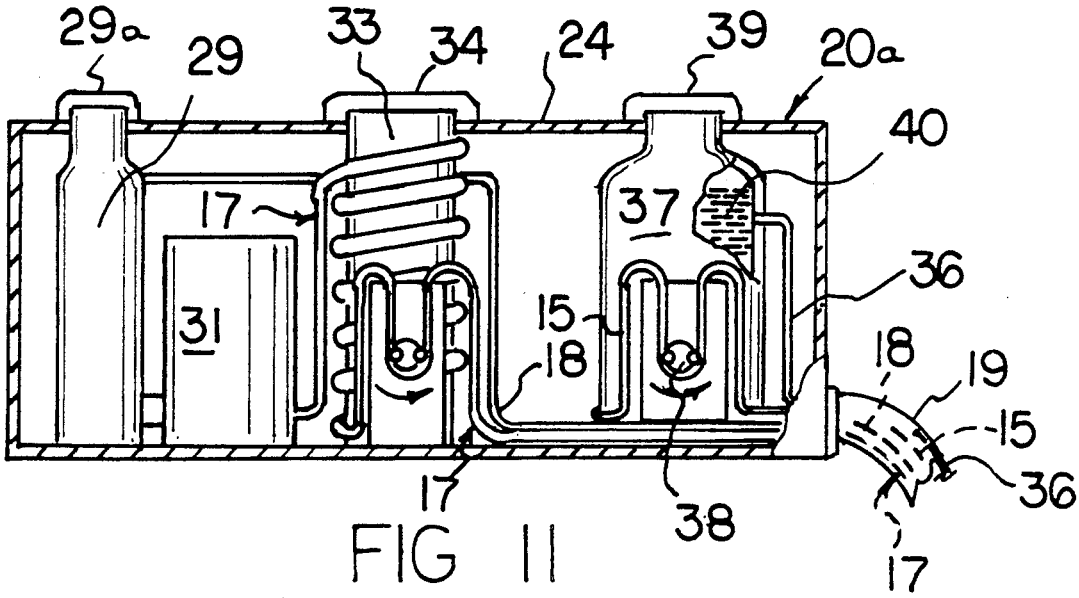
FIG. 11 is an orthographic cross-sectional illustration of a modified control housing of the invention.

The FIG. 11 illustrates the use of an additional or second fluid reservoir 37, including fluid therewithin at ambient air temperature relative to the blanket 11, such as illustrated in FIG. 12. The second fluid reservoir 37 is cooperative with a second pump 38 through an independent second reservoir conduit structure to include the tubular guide mandrel 15 that directs fluid from the second fluid reservoir 37 through the blanket cavity and return such fluid through the guide mandrel return line 36 returning such fluid back into second fluid reservoir 37. A second reservoir lid 39 permits access interiorly of the second reservoir to provide for positioning of fluid at a desired temperature prior to its positioning within the second reservoir of the ambient air temperature fluid 40. In this manner, the blanket 11 may be maintained at room temperature minimizing energy consumption and preventing undesirable heating and cooling of the blanket by merely the blanket brought to a comfortable temperature.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A heating and cooling blanket apparatus, comprising, a flexible blanket member, the flexible blanket member including a first layer arranged coextensively to a second layer defining a blanket cavity therebetween, and a fluid conduit directed into the blanket cavity including an input conduit and a return conduit, and the input conduit and return conduit directed through a covering sheath, and the input conduit and the return conduit directed through the covering sheath and further including a control housing, with the input conduit and return conduit directed into the control housing, the control housing including a pump member mounted to the input conduit and a fluid reservoir contained within the control housing, and heating means and cooling means mounted within the control housing in fluid communication with the input conduit for effecting selective heating and cooling of fluid contained within the input conduit, and the control housing includes a control housing top wall and a control housing front wall, and the fluid reservoir fixedly mounted within the control housing projecting through the control housing top wall, and a fluid reservoir lid mounted to an upper distal end of the fluid reservoir positioned above the control housing top wall, and the heating means including a fluid heating container in fluid communication with the fluid reservoir, wherein the fluid heating container includes a heating member contained therewithin, and a temperature sensor mounted to the fluid heating container, and a control member mounted on the control housing front wall for effecting selective heating of the heating member within the fluid reservoir.

2. An apparatus as set forth in claim 1 wherein the cooling means includes the input conduit configured in a helical cooling coil configuration, and the helical cooling coil configuration including a cooling container, the cooling container slidably mounted within the helical cooling coil configuration, and the cooling container positioned below a top wall opening, and the helical cooling container slidably mounted within the helical cooling coil configuration and arranged for projection through the top wall opening, the cooling container including a cooling container lid to permit selective filling of the cooling container with a cooling medium.

3. An apparatus as set forth in claim 2 wherein the control housing includes a second fluid reservoir, the second fluid reservoir including a tubular guide mandrel in fluid communication with the second fluid reservoir directed through the covering sheath into the blanket member, and the fluid-flow conduit helically wound about the tubular guide mandrel, and the tubular guide mandrel including a guide mandrel return line directed from the blanket cavity to the second fluid reservoir, and the second fluid reservoir including a fluid medium, and the fluid medium arranged at ambient air temperature relative to the blanket member.

4. An apparatus as set forth in claim 3 including a second pump in operative communication with the tubular guide mandrel to effect flow through the tubular guide mandrel from the second fluid reservoir.

* * * * *